US006647835B1

(12) United States Patent
Tseng

(10) Patent No.: US 6,647,835 B1
(45) Date of Patent: Nov. 18, 2003

(54) PLIERS WITH REPLACEABLE JAWS

(75) Inventor: Yi Chuan Tseng, Taichung Hsien (TW)

(73) Assignee: AWI Acquisition Company, Sylmar, CA (US)

( * ) Notice: Subject to any disclaimer, the term of this patent is extended or adjusted under 35 U.S.C. 154(b) by 0 days.

(21) Appl. No.: 10/274,240

(22) Filed: Oct. 17, 2002

(51) Int. Cl.[7] ..... B25B 7/02
(52) U.S. Cl. ..... 81/423; 81/305; 81/416
(58) Field of Search ..... 81/423, 421, 422, 81/418, 417, 416, 318, 319, 323, 324, 305

(56) References Cited

U.S. PATENT DOCUMENTS 816,674 A * 4/1906 Medhus ..... 7/133
1,079,997 A * 12/1913 Wernimont ..... 294/3
1,657,348 A * 1/1928 Drumm ..... 81/412
2,651,227 A * 9/1953 Kennington, Jr. ..... 81/305
4,793,224 A * 12/1988 Huang ..... 81/302
5,245,721 A * 9/1993 Lowe et al. ..... 7/129
6,023,805 A * 2/2000 Lin ..... 7/128
6,131,495 A * 10/2000 Chen ..... 81/423
6,223,374 B1 * 5/2001 Lin ..... 7/127
6,250,184 B1 * 6/2001 Chang ..... 81/415
6,257,105 B1 * 7/2001 Lin ..... 81/302
6,282,995 B1 * 9/2001 Lin ..... 81/423
6,336,387 B1 * 1/2002 Lee ..... 81/415

* cited by examiner

*Primary Examiner*—Joseph J. Hail, III
*Assistant Examiner*—Hadi Shakeri
(74) *Attorney, Agent, or Firm*—Jack C. Munro

(57) ABSTRACT

A scissors pair of pliers where the pair of jaws of the pliers are to be replaceable with a different pair of jaws.

4 Claims, 3 Drawing Sheets

PLIERS WITH REPLACEABLE JAWS

BACKGROUND OF THE INVENTION

1. Field of the Invention

The field of this invention relates to hand tools and more particularly to a pair of pliers where the pair of jaws are replaceable with a different type of pair of jaws.

2. Description of the Related Art

A hand tool in the form of a pair of pliers has long been known. A conventional form of a pair of pliers comprises a pair of handles mounted in a scissors arrangement. One end of the handles is adapted to connect with a user's hand. The opposite end of the handles includes an operating head. Generally, the operating head includes a pair of jaws. Squeezing together of the handles results in the jaws being closed. An object that is to be gripped is to be located between the jaws, and when the jaws are closed, the object is gripped.

Pliers come in numerous different configurations. The most common configuration of pliers is what is called a slip joint pliers where the jaw elements of the pliers are blunted. Also, another type of blunted jaw pliers, commonly referred to as a lineman's pliers, which includes a wire cutter. Also, a wire cutter is commonly included within a needle nose pliers and long nose plier. There are many additional configuration of pliers where the jaws of the pliers may be flattened, may be arcuate or may include a special configuration for gripping onto a particular type of structure such as diagonal cutting plier, combination plier, wire stripper, fencing plier, rabit pincer, carpenter plier, water pump plier, flat nose plier, hose clamp plier and end nipper.

In the past, if a homeowner or tradesman desired to have pliers with different configuration of jaws, it was required that the individual purchase a pair of pliers each having the specific jaw configuration desired. This can result in substantial expense just for pliers. All the different configurations of pliers have the same scissors handle arrangement. Why couldn't a pliers be constructed with the jaws of the pliers being replaceable with different configurations thereby eliminating the need to purchase several different sets of pliers.

SUMMARY OF THE INVENTION

A first embodiment of a pair of pliers which comprises a pair of scissorly arranged handles with one end of the scissors handles forming an operating head. An internal cavity is formed within the operating head. The operating head includes a pair of jaw mounts with the internal cavity being located between these jaw mounts. A first pair of jaws that are pivotally connected together are to be mountable within the internal cavity. The first pair of jaws is movable between an open position and a closed position with the closed position comprising the gripping position. The first pair of jaws is to be movable from the open position to the closed position by manual squeezing of the handles. The first pair of jaws are to be removable from the internal cavity to thereby be replaced with a second pair of jaws of a different type.

A further embodiment of the present invention is where the first embodiment is modified by either the first pair of jaws or the second pair of jaws including a first pair of jaw elements and a second pair of jaw elements.

A further embodiment of the present invention is where the first embodiment is modified by including within the operating head of the pliers and the pair of jaws of the pliers an interlocking engagement.

A further embodiment of the present invention is where the just previous embodiment is modified by the interlocking engagement comprising a spring biased ball assembly which is to connect with a recess arrangement which will function to precisely locate the jaws within the operating head.

A further embodiment of the present invention is where the first basic embodiment is modified by there being a means for engagement mounted between each jaw mount and the pair of jaws. This means for engagement locks the jaw mounts to the handles preventing accidental disengagement during usage of the pliers.

A further embodiment of the present invention is where the first embodiment is modified by the jaw mounts including pins which are to engage with recesses formed in the pair of jaws which will function to keep the jaws locked to the operating head during usage of the pliers and prevent accidental disengagement of the jaws relative to the pliers. Disengagement of the jaws relative to the operating head is only permitted when the jaws are in the open position and not gripping an exterior structure.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
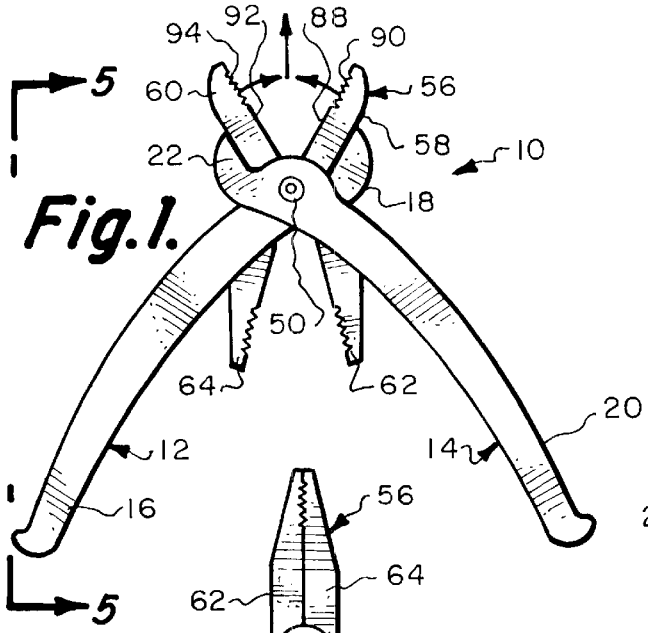
FIG. 1 is a frontal view of the first embodiment of pliers of the present invention showing a blunt nose type of jaws in position for usage and in the open position.

Referring particularly to the drawings, there is shown in FIGS. 1–7 the first embodiment 10 of pliers of this invention. The first embodiment of pliers 10 includes an elongated handle 12 and an elongated handle 14. The handle 12 includes a grasping end 16 and at the opposite end a jaw mount 18. In a similar manner, the handle 14 includes a grasping end 20 and at the opposite end a jaw mount 22. Handle 12 and handle 14 are each to be constructed of a rigid material with generally a metallic material being preferable. However, any rigid non-metallic material could also be used. Handle 12 includes a hollow open chamber 24 that divides the handle 12 into a pair of parallel spaced apart panels 26 and 28. Mounted between the panels 26 and 28 is a pin 30. Formed within the panel 26 is a hole 32 and formed within the panel 28 is a hole 34.

In a similar manner, the handle 14 includes a hollow chamber 36 that is actually slightly wider than the width of the handle 12. The reason for this is that the handle 12 is to be slipped through the hollow chamber 36 until hole 32 aligns with hole 38 formed in panel 40 of handle 14. Also at the same time, hole 34 will align with hole 42 formed in panel 44 of handle 14. Fixedly mounted between the panels 42 and 44 is a pin 46. The precise constructional arrangement between the handles 12 and 14 is not only used within the first embodiment 10 of this invention, but is also utilized within the second embodiment 48. Within the aligned pair of holes 32 and 38 there is mounted a pivot pin 50. A similar pivot pin 52 is mounted within the aligned pair of holes 34 and 42. Pins 50 and 52 could take the form of rivets, a screw fastener or a bolt fastener. The pivot pins 50 and 52 permit the handles 12 and 14 to be pivoted relative to each other in a scissors type arrangement.

The jaw mounts 18 and 22 cooperate together to form an operating head for the first embodiment 10 of pliers of this invention. This operating head between the jaw mounts 18 and 22 forms an internal cavity 54. Within the internal cavity 54 is to be located a pair of jaws 56. The first pair of jaws 56 comprises a pair of members which are pivotally connected together also in a scissors type arrangement. The pair of jaws 56 form a joinable pair of first jaw elements 58 and 60 and a second pair of joinable jaw elements 62 and 64.

The jaw element 58 is integral to jaw element 64 with there being a center section 66 located therebetween. A similar center section 68 is formed integral with the jaw elements 60 and 62. The center section 66 has integrally formed thereon a sleeve 70. Sleeve 70 includes a through passage 72. Mounted within the through passage 72 is a coil spring 74. Each end of the coil spring 74 is to connect with a metallic ball 76 with it being understood that there are two in number of such balls 76. The balls 76 are restrained to not be disengageable from the through passage 72. However, each ball 76 will have a tendency to protrude slightly from the sidewalls of the pair of jaws 56 under the action of the bias of the coil spring 74. During insertion of handle 12 through hollow chamber 36 these balls 76 will be pushed into through passage 72. When the balls 76 align with holes 32, 34, 38 and 42, the balls 76 will then be biased outwardly by spring 74 and protrude. Surrounding the sleeve 70 is a ring spring 78. Ring spring 78 has laterally extending ends 80 and 82. End 80 connects with a hole, which is not shown within the center section 66 and end 82 connects with hole 84 formed within the center section 68. The location of the hole which is not shown and hole 84 is such that there is a continuous bias that is emitted by the ring spring 78 that will tend to locate the pair of jaws 56 in a constantly open position, which is shown generally in FIGS. 1, 4 and 6 of the drawings. The ring spring 78 fits within annular groove 86 of the center section 66.

Figures 5, 6, 8, 9, 10:
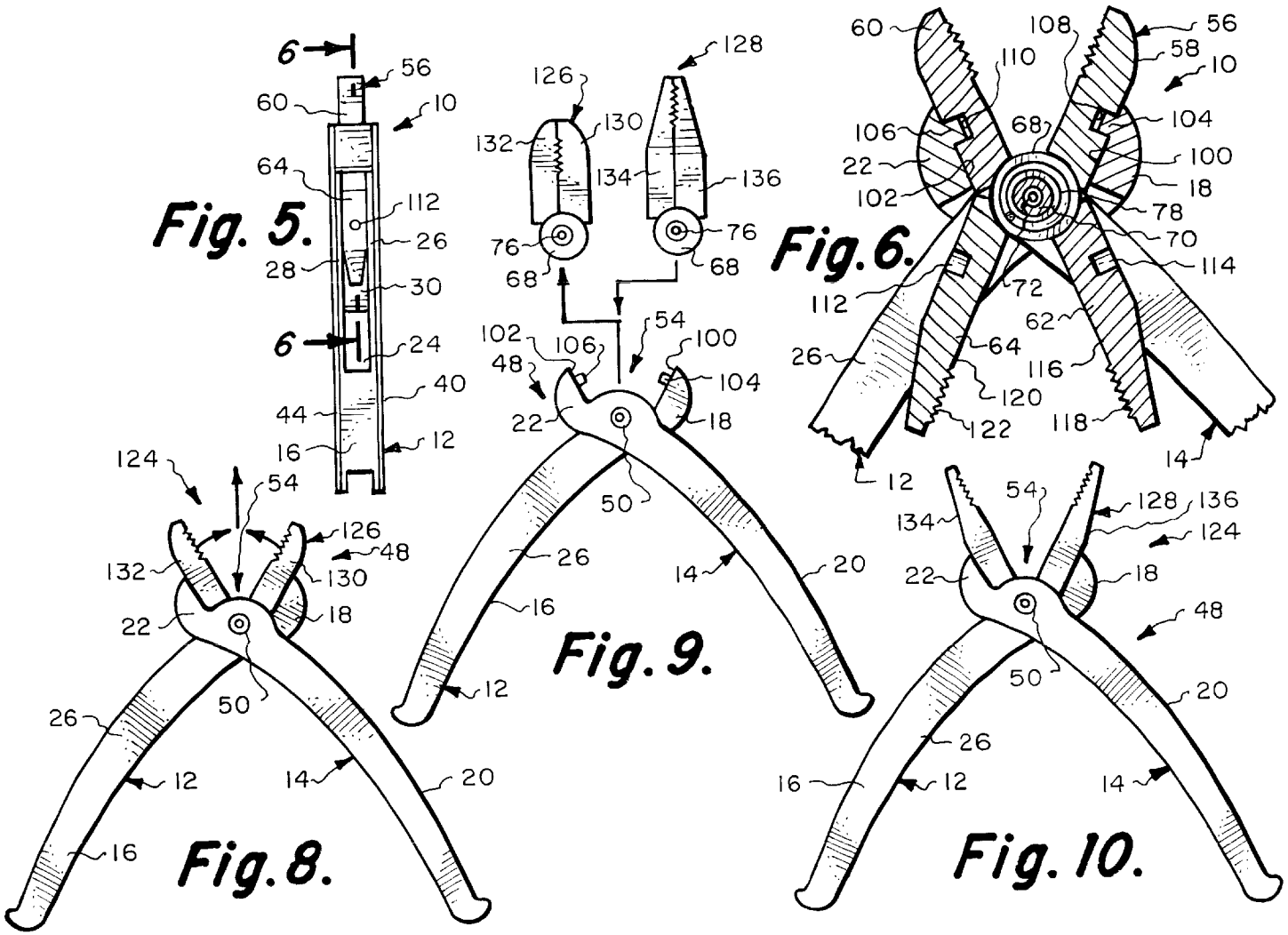
FIG. 5 is a side elevational view of the first embodiment of pliers taken along line 5—5 of FIG. 1.
FIG. 6 is a cross-sectional view through the operating head and pair of jaws mounted therein taken along line 6—6 of FIG. 5.
FIG. 8 is a frontal view of a second embodiment of pliers of the present invention showing blunt nosed jaws again showing the pliers in the open configuration.
FIG. 9 is a view similar to FIG. 8 but with the pair of jaws being removed from the second embodiment of pliers and also depicting a second pair of jaws of a different type that are capable of being engaged in conjunction with the second embodiment of pliers.
FIG. 10 is a view similar to FIG. 8 but instead of having the blunt nosed pair of jaws connecting with the pliers there is utilized needle nose type of jaws connecting with the pliers.
Figure 7:
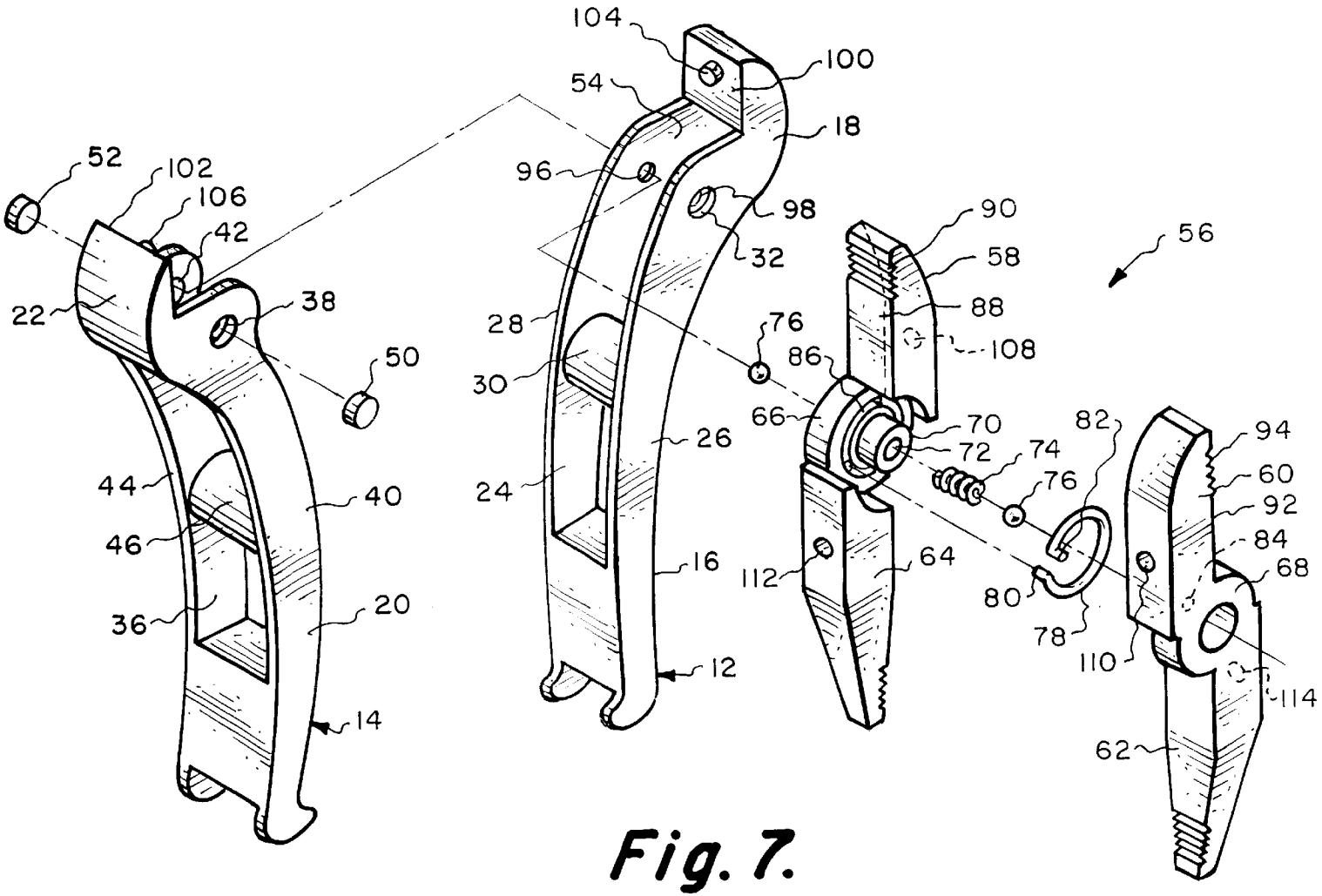
FIG. 7 is an exploded isometric view of the first embodiment of pliers showing the different parts that are utilized in conjunction with the basic embodiment of pliers of this invention.

The jaw mount 58 has a front gripping surface 88 which is basically planar which has formed thereon a series of serrations 90 that facilitate gripping an exterior object. The jaw element 60 also includes a front planar gripping surface 92 which has formed thereon a series of serrations 94 that are also to facilitate gripping an exterior structure. An exterior object is to be gripped between the gripping surfaces 88 and 92. When the pair of jaws 65 is mounted as shown in FIGS. 1 and 6 of the drawings, one ball 76 connects with small hole 96 formed in panel 28, and the opposite ball 76 connects with small hole 98 formed in panel 26. Small hole 96 is in alignment with hole 42 and small hole 98 is in alignment with hole 32. The function of the small holes 96 and 98 in connection with the balls 76 is to interlockingly mount the pair of jaws 56 in a precise position within the cavity 54.

The jaw mount 18 has an inner planar surface 100. Jaw mount 22 also has a similar inner planar surface 102. Planar surface 100 is to be normally located flush against the outer surface of either jaw element 58 or jaw element 64. Planar surface 102 is to be normally located flush against the outer surface of either jaw element 60 or jaw element 62. Mounted on the surface 100 is a pin 104. A similar pin 106 is fixedly mounted on the surface 102. Mounted in the outer surface of the first jaw element 58 is a recess 108. Pin 104 is to be locatable within the recess 108. The pin 106 is to be locatable within the recess 110 formed in the outer surface of the jaw element 60.

Figure 2:
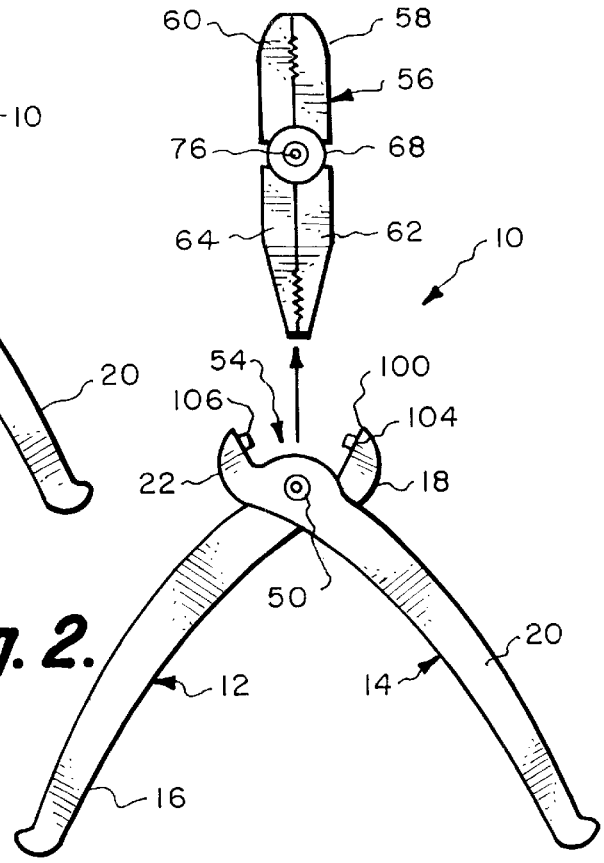
FIG. 2 is a view similar to FIG. 1 but showing the jaws being disengaged from the handles of the pliers.
Figure 3:
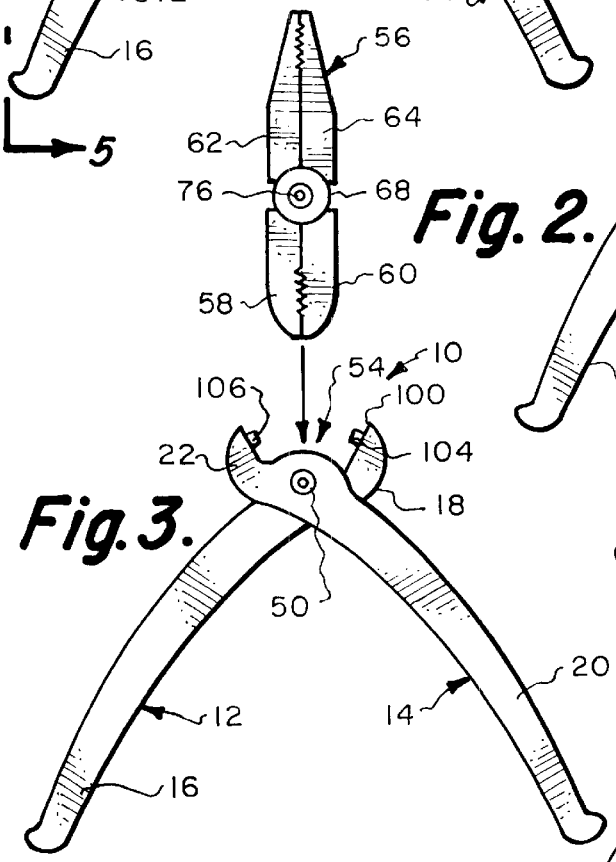
FIG. 3 is a view similar to FIG. 2 but showing the jaws being turned around one hundred and eighty degrees and being depicted to be moved into engagement with the handles of the pliers.
Figure 4:
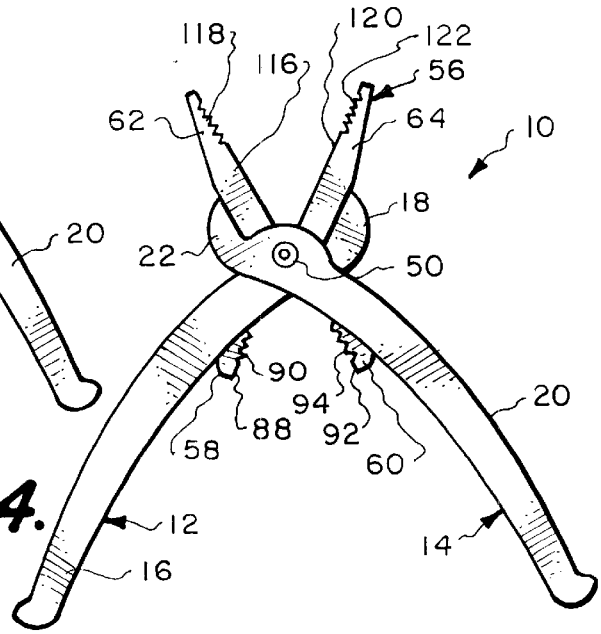
FIG. 4 is a view similar to FIG. 1 but where the type of jaws that are intended to be used are a needle nose type.

When the first jaw elements 58 and 60 are in the outwardly extending position, which is the primary usable position of the first embodiment 10 of pliers of this invention, and force is applied by the handles to squeeze the handles 16 and 20 together, the jaw mounts 18 and 22 cause movement of their respective jaw elements 58 and 60 toward one another which will apply a gripping force onto an exterior object. If an outwardly directed pulling force is applied to the pliers 10 of this invention, the pins 104 and 106 in connection with their respective recesses 108 and 100 will prevent disengagement of the pair of jaws 56 from the handles 12 and 14. The only way that the pair of jaws 56 can be disengaged from the handles 12 and 14 is that when the first embodiment 10 is not gripping any exterior structure and the first embodiment 10 is in the open position as shown in FIGS. 1 and 6, a user can manually press together jaw elements 58 and 60 which will result in the pins 104 and 106 being disengaged from recesses 108 and 110. This will then permit the pair of jaws 56 to be manually extracted from the internal cavity 54, as is shown in FIG. 2 of the drawings. The user can then turn the pair of jaws 56 one hundred and eighty degrees and reinsert the pair of jaws 56 within the cavity 54 until the balls 76 reengage with small holes 96 and 98. In this particular position, the second jaw elements 62 and 64, which is shown needle nosed, are to be usable to effect gripping on an exterior object. Jaw element 64 has a recess 112 which is to be engaged with pin 104. Jaw element 62 has a recess 114 which is to engage with pin 106. Jaw element 62 has a gripping surface 116 which has formed thereon a series of serrations 118. Second jaw element 64 has a gripping surface 120 which has formed thereon a series of serrations 122.

It can thus be seen that with the first embodiment 10 of this invention that the pair of jaws 56 can be manually quickly disengaged from the cavity 54 and turned around and reinserted with the cavity 54 in order to change the configuration of the pliers of the first embodiment 10. It is to be understood that there could be utilized a plurality of different pair of jaws 56 in order to obtain different types of jaw elements. The force that is applied to close the jaw elements 58 and 60 is by means of pins 30 and 46 with pin

30 pressing against second jaw element 64 and pin 46 pressing against second jaw element 62. When the pair of jaws 56 are in the reverse position, shown in FIG. 4 of the drawings, the closing force is applied by pin 30 against jaw element 58 and pin 46 against jaw element 60.

Referring particularly to FIGS. 8–10 of the drawings, there is shown the second embodiment 124 of this invention. Like numerals have been utilized to refer to like parts. Instead of the pair of jaws 56 being reversible, there is to be insertable within the cavity 54 individual jaws 126 or 128. Jaws 126 are basically in the same shape as jaw elements 58 and 60. Jaws 128 are basically in the same configuration as jaw elements 62 and 64. Jaws 126 includes jaw elements 130 and 132 which are locatable in position in the same manner using small balls 76. The pair of jaws 128 also has jaw elements 134 and 136 which are also mountable in conjunction within the cavity 54 by small balls 76 engaging with small holes 96 and 98. It is again to be understood that there could be utilized a wide variety in number of different configuration of jaws 126.

What is claimed is:

1. A pair of pliers comprising:

a pair of handles mounted in a scissors arrangement;

an operating head having an internal cavity, said operating head including a pair of jaw mounts, said internal cavity being located between said jaw mounts;

a first pair of jaws pivotally connected together, said first pair of jaws being mountable within said internal cavity, said first pair of jaws being movable between an open position and a closed position, said first pair of jaws being removable from said internal cavity to thereby be replaceable with a second pair of jaws of a different type; and said first pair of jaws being attached to said second pair of jaws, both said first pair of jaws and said second pair of jaws each including a first pair of jaw elements and a second pair of jaw elements, said second pair of jaw elements being reversely oriented relative to said first pair of jaw elements.

2. A pair of pliers comprising:

a pair of handles mounted in a scissors arrangement;

an operating head having an internal cavity, said operating head including a pair of jaw mounts, said internal cavity being located between said jaw mounts;

a first pair of jaws pivotally connected together, said first pair of jaws being mountable within said internal cavity, said first pair of jaws being movable between an open position and a closed position, said first pair of jaws being removable from said internal cavity to thereby be replaceable with a second pair of jaws of a different type; and interlocking engagement means mounted on said first pair of jaws for connecting with said operating head for precisely locating said first pair of jaws with said operating head; and said interlocking engagement means comprises a spring biased ball assembly which is to be deflected during engaging of said first pair of jaws with said operating head and upon achieving the proper location said spring biased ball assembly to expand and connect to a recess arrangement.

3. The pair of pliers as defined in claim 2 wherein:

means for engagement mounted between each said jaw mount and said pair of jaws, said means for engagement locking together said jaw mounts and said pair of jaws preventing accidental disengagement of said first pair of jaws from said jaw mounts during usage of said pliers.

4. The pair of pliers as defined in claim 1 wherein:

each of said jaw mount includes a protruding pin, each said protruding pin to engage with a recess formed within each said jaw element, whereby either said first pair of jaws or said second pair of jaws is securely locked to said operating head during usage of said pliers preventing accidental disengagement of either said first pair of jaws or said second pair of jaws relative to said operating head.

* * * * *